US007036553B1

(12) United States Patent
Yu

(10) Patent No.: US 7,036,553 B1
(45) Date of Patent: May 2, 2006

(54) DIE-CASTING DEVICE

(76) Inventor: Jih-Lee Yu, P. O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/994,375

(22) Filed: Nov. 23, 2004

(51) Int. Cl.
*B22D 17/12* (2006.01)

(52) U.S. Cl. ..... 164/312; 164/313; 164/314

(58) Field of Classification Search ..... 164/312, 164/314, 313, 136
See application file for complete search history.

(56) References Cited

U.S. PATENT DOCUMENTS 4,088,178 A * 5/1978 Ueno et al. ..... 164/314
4,986,335 A * 1/1991 Koch ..... 164/312
5,284,201 A * 2/1994 Hegel et al. ..... 164/312
5,350,006 A * 9/1994 Hanano ..... 164/267

* cited by examiner

*Primary Examiner*—Len Tran
(74) *Attorney, Agent, or Firm*—Troxell Law Office, PLLC

(57) ABSTRACT

A die-casting device at least includes a housing having a seat, a lower mold mechanism at the seat, an oil-pressured injection mechanism joined with a lower section of the lower mold mechanism, and a corresponding upper mold mechanism disposed at an upper section of the housing and driven by an oil-pressured mechanism for up-and-down movements; wherein, the lower mold mechanism is devised as a structure with an outwardly inclined angle. Thus, when adding a metal liquid to the die-casting device, the lower mold mechanism is first inclined outward, such that when the metal liquid is flowed in to a material reservoir of an injection mechanism, a flow speed of the metal liquid is reduced to avoid formation of the bubbles, thereby preventing finished die-casting products from containing bubbles and thus elevating product quality.

3 Claims, 5 Drawing Sheets

DIE-CASTING DEVICE

BACKGROUND OF THE INVENTION (a) Field of the Invention

The invention relates to a die-casting device, and more particularly, to a lower mold mechanism of an upright die-casting device. The lower mold mechanism is devised as being inclined with an appropriate angle, such that when a metal liquid is filled into a material reservoir at an upper section of an injection mechanism, a flow speed thereof is reduced to avoid formation of bubbles, thereby preventing finished die-casting products from containing bubbles and thus elevating product quality.

(b) Description of the Prior Art

A prior die-casting device comprises at least a lower mold mechanism at a seat of a machine body thereof. The lower mold mechanism has a lower section thereof joined with an oil-pressured injection mechanism, and the machine body has an upper section thereof provided with a corresponding upper mold mechanism driven by an oil-pressured mechanism for up-and-down movements. When the lower mold mechanism is filled with a metal liquid, the upper mold mechanism is descended to correspond and seal with the lower mold mechanism, followed by the injection mechanism pressing the aforesaid metal liquid into a mold chamber between the upper and lower mold mechanisms to complete die-casting.

However, during a process of adding a metal liquid of zinc, tin, aluminum or copper for die-casting using the aforesaid prior die-casting device, for that the lower mold mechanism of the prior die-casting device is an immobile and upright structure, the metal liquid is rapidly and vertically rushed into a material reservoir at an upper end of the injection mechanism when a metal liquid device pours the metal liquid through a cast opening of the lower mold mechanism. As a result, bubbles in the metal liquid in the material reservoir are frequently produced. These bubbles are aluminum oxides commonly referred to as dregs. Similar to pouring water, when the poured water comes to direct impact with a surface of the water, numerous bubbles are formed in the water. However, such phenomenon is quickly disappeared in water, whereas in a liquid having little fluidity and high cohesion, it is rather difficult to totally eliminate bubbles contained in the metal liquid that is filled into the mold chamber and takes formation in an extremely short period before the metal liquid solidifies. Thus, many bubbles are often remained in finished die-casting products using the prior die-casting device. Strength and appearance quality of such products are affected to reduce competitiveness and economical values of these products on market. It is essential that the prior die-casting device be advanced.

SUMMARY OF THE INVENTION

The primary object of the invention is to provide a die-casting comprising a lower mold mechanism devised as being inclined with an appropriate angle, such that when a metal liquid is added by a liquid supply mechanism, formation of bubbles is prevented during a process of filling the metal liquid into a material reservoir and thus elevating die-casting quality.

The secondary object of the invention is to provide a die-casting device, wherein a piston simultaneously contracts downwards when an injection mechanism adds a metal liquid, such that the metal liquid is allowed with enhanced buffer effects when being filled into the material reservoir.

To accomplish the aforesaid objects, a die-casting device according to the invention comprises a lower mold mechanism that is devised as a structure capable of outwardly inclining with an appropriate angle. Thus, when adding a metal liquid of the die-casting device, the lower mold mechanism is first inclined outward, so that when the metal liquid is flowed in to a material reservoir of an injection mechanism, and a flow speed of the metal liquid is reduced to avoid formation of the bubbles from impact, thereby preventing finished die-cast products from containing bubbles and thus elevating product quality.

DETAILED DESCRIPTION OF THE PREFERRED EMBODIMENTS

To better understand structural characteristics and effects of the invention, detailed descriptions of a preferred embodiment shall be given with the accompanying drawings below.

Figure 1:
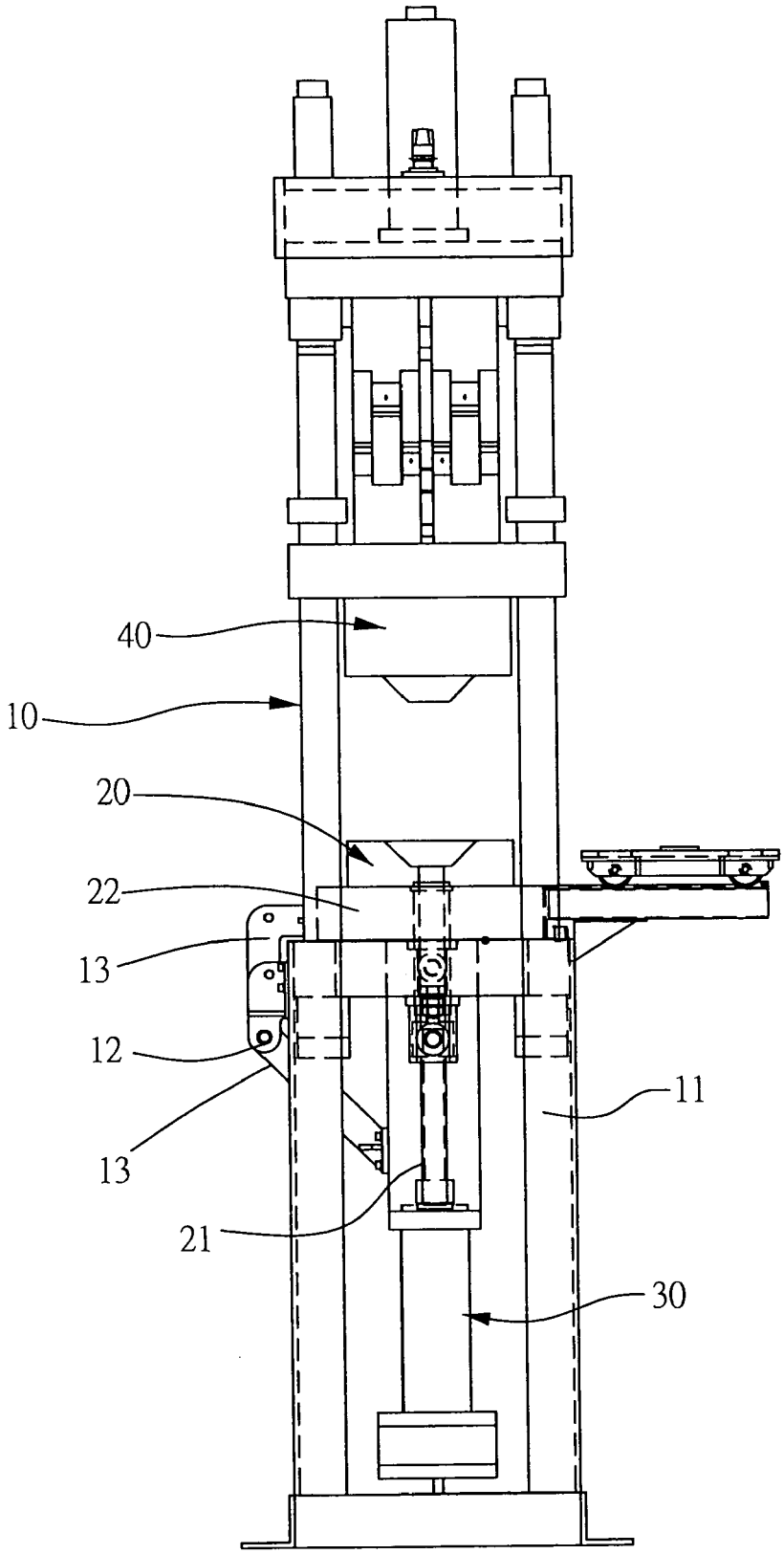
FIG. 1 shows a planar view illustrating an assembly of the die-casting device according to the invention.
Figure 2:
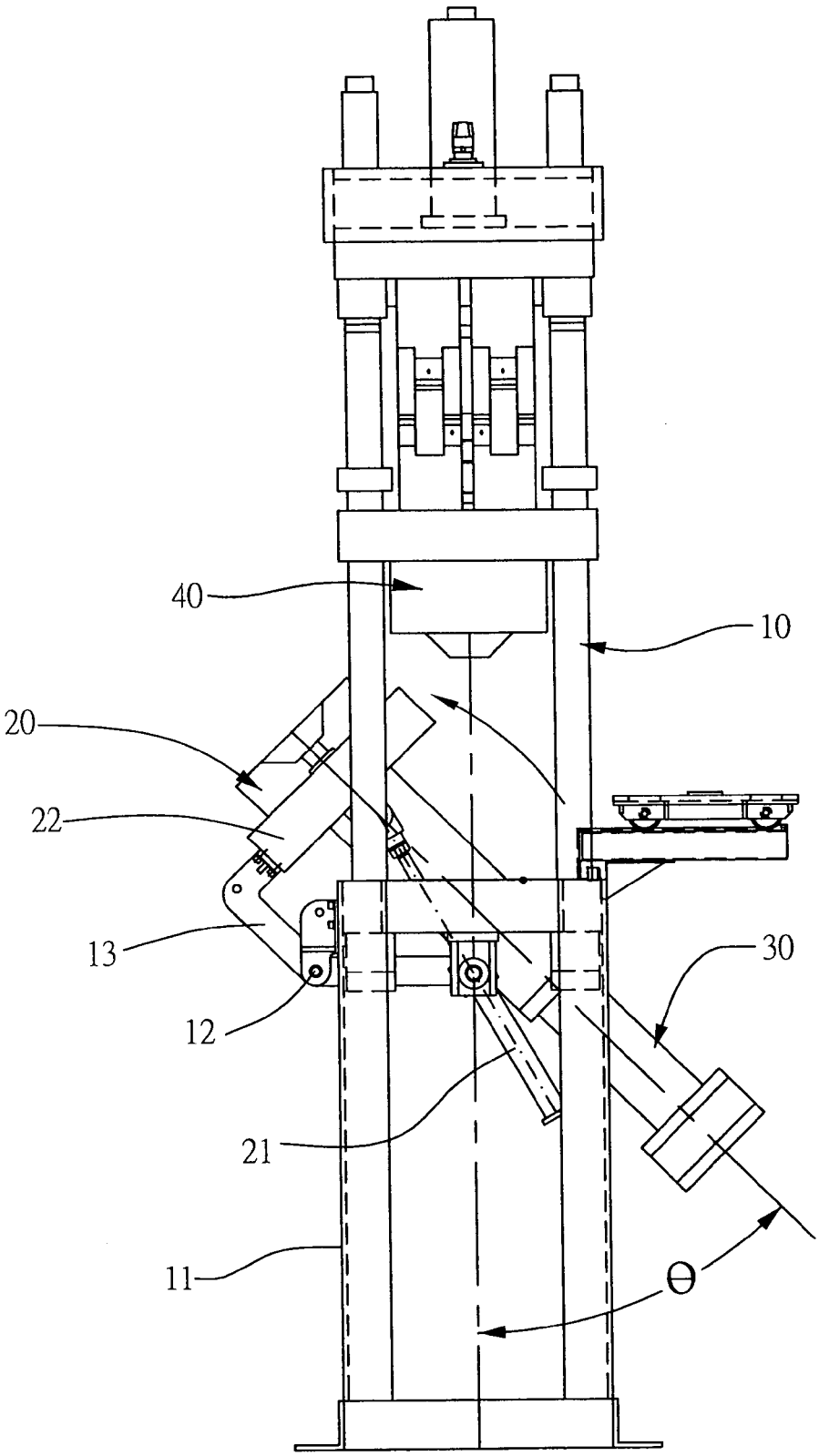
FIG. 2 shows a schematic view illustrating the inclined lower mold mechanism of the die-casting device according to the invention.

Referring to FIG. 1, a die-casting device according to the invention at least comprises a housing 10 having a seat 11, a lower mold mechanism 20 at the seat 11, an oil-pressured injection mechanism 30 joined with a lower section of the lower mold mechanism 20, an upper mold mechanism 40 correspondingly disposed at an upper section of the housing 10 and driven by an oil-pressured mechanism for up-and-down movements. The invention is characterized that, the lower mold mechanism 20 is devised with an inclined angle θ at an outward direction as shown in FIG. 2, with the angle θ preferably ranging between 30 and 50 degrees.

Figure 3:
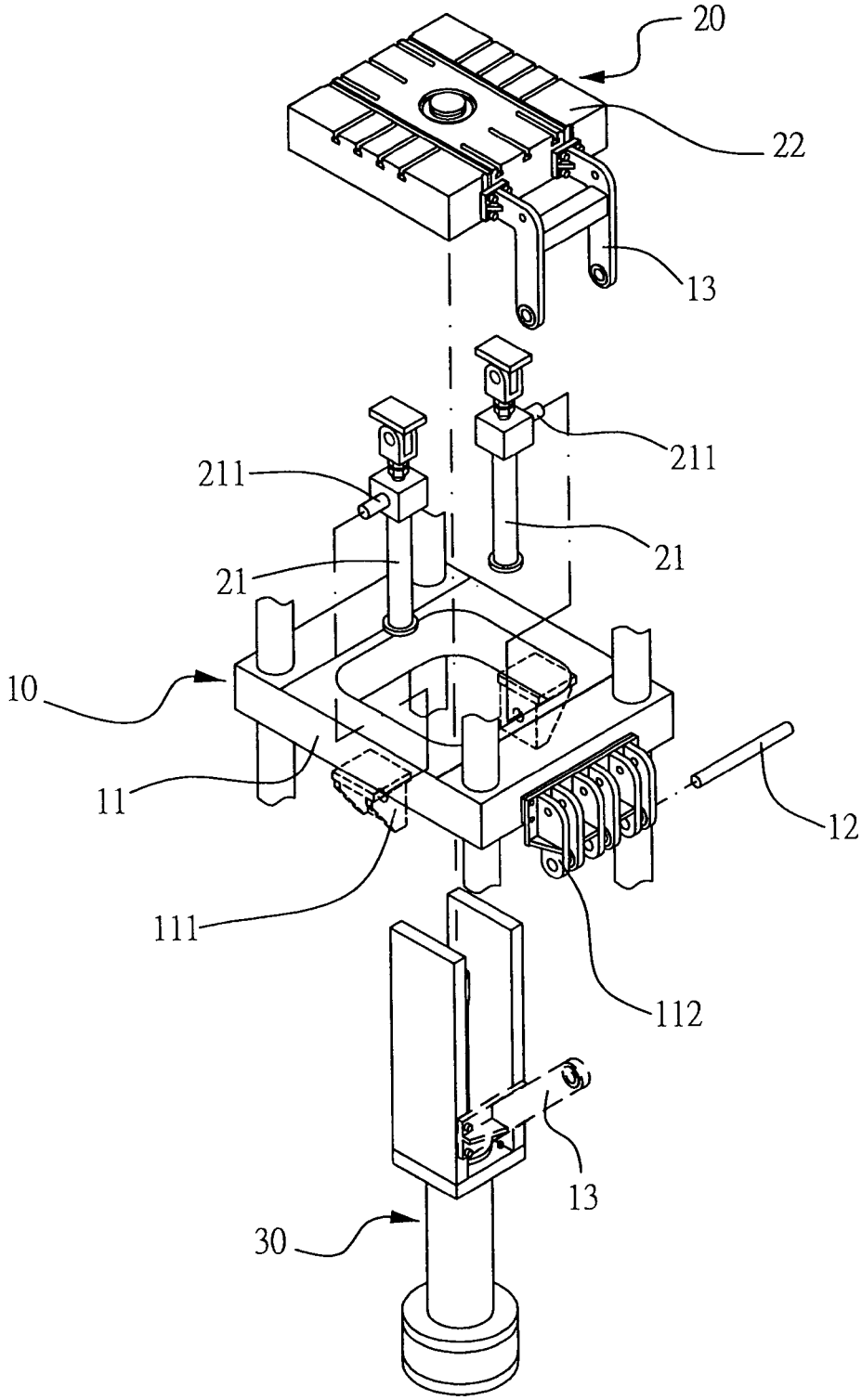
FIG. 3 shows an exploded elevational view of the lower mold mechanism according to the invention.

Referring to FIG. 3, the lower mold mechanism 20 is located at an at a center area of an upper section of the seat 11, and is supported and located using symmetrical oil-pressured valves 21. Each of the two oil-pressured valves 21 has an upper end of an outer tube thereof provided with a perpendicularly and outwardly projected axis 211, which is pivotally joined with an axis housing 111 respectively disposed at two upper sides of the seat 11. Parallel to the rotation axes 211 of the oil-pressured valves 21, the seat 11 has a crank axis seat 112 and a pivotal axis 12 at one upper side thereof. A pivotal crank 13 is formed by penetrating the pivotal axis 12 through the crank axis seat 112; in this embodiment, the crank is a two sectional structure. The crank 13 has an upper end thereof fastened at a side wall of a mold housing 22 of the lower mold mechanism 20, and a lower end thereof fastened at a region between the mold housing 22 of the lower mold mechanism 20 and the injection mechanism 30 to form one body with the lower mold mechanism 20. When the oil-pressured valves 21 are contracted, the lower mold mechanism 20 is enable to mold and cast by placing the mold seat 22 thereof on the housing 11. When the oil-pressured valves 21 are extended, the lower mold mechanism 20 and the injection mechanism 30 are together ascended, and are rotated outward regarding the pivotal axis 12 as a center thereof to become inclined.

Figure 4:
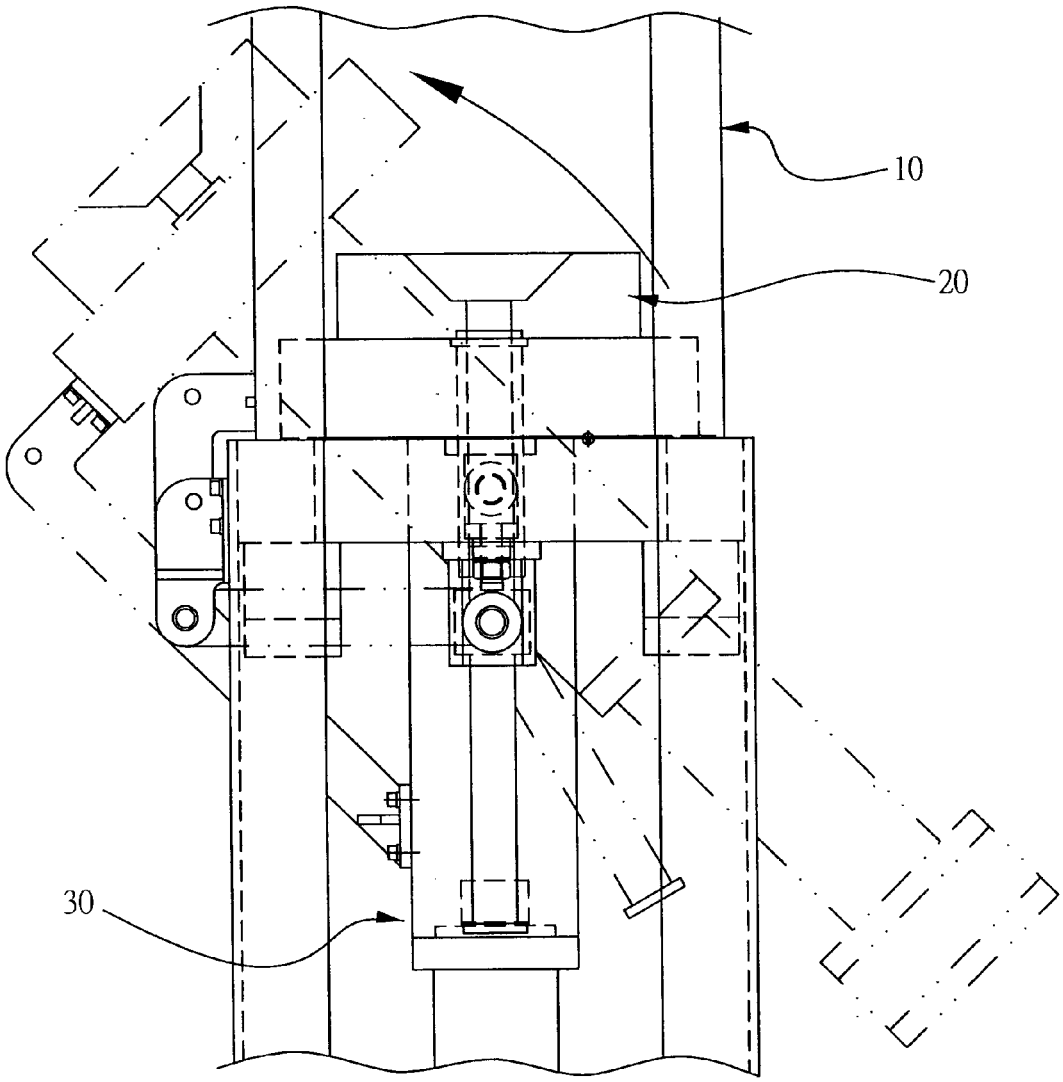
FIG. 4 shows a partial planar schematic view illustrating motions of the lower mold mechanism according to the invention.
Figure 5:
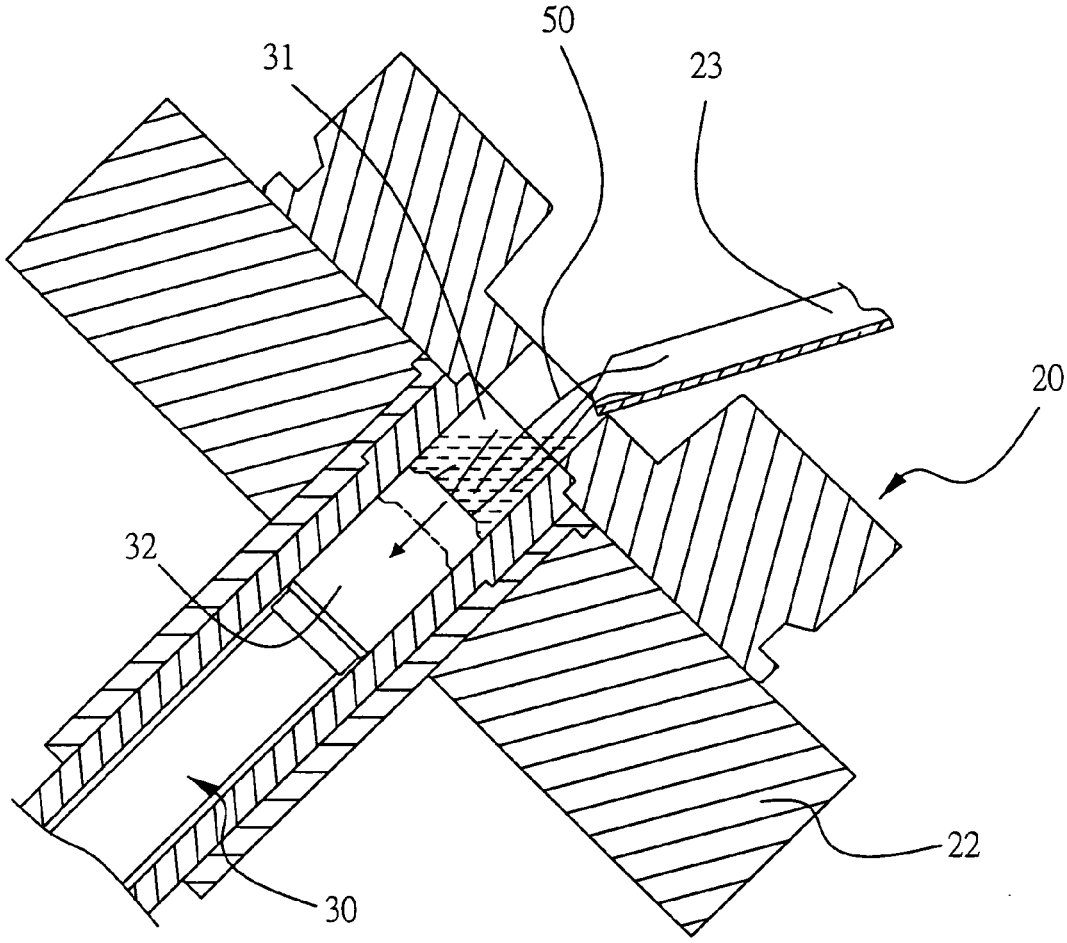
FIG. 5 shows a schematic view illustrating a metal liquid being cast using the die-casting device according to the invention.

When adding a metal liquid to the aforesaid structure, the lower mold mechanism 20 is lifted using the oil-pressured valves 21 as shown in FIG. 4, and the oil-pressured valves 21 are rotated for that the mold housing 22 at the upper section of the lower mold mechanism 20 is retained by the crank 13. At this point, the lower mold mechanism 20, the injection mechanism 30 and the crank 13 are all rotated relative to the pivotal axis 12, thereby inclining the lower mold mechanism 20 outward with a certain angle. Thus, when adding a metal liquid as shown in FIG. 5, a metal liquid 50 is flowed into a metal reservoir 31 at an upper section of the injection mechanism 30 via the liquid supplying device along an inclined cast channel 23. Owing to a relatively slow flow speed, no bubbles are formed in the absence of impact, just as foam is unlikely produced when pouring soda water into a tilted glass. Therefore, using the aforesaid structure for die-casting, bubbles are much less likely contained in finished products to further elevate product quality.

Referring to FIG. 5, when adding the metal liquid 50, using controls of an electric circuit, a piston 32 of the injection mechanism 30 is simultaneously drawn downward from beginning till end of adding the metal liquid 50. Hence, the metal liquid 50 liquid is offered with buffer effects for reception when being poured into the material reservoir 31, thereby further reinforcing preventing formation of bubbles in the poured metal liquid 50.

Conclusive from the above, the invention has simple structures, and is capable of reducing a flow speed of a metal liquid and thus preventing formation of bubbles when pouring a metal liquid, thereby enhancing quality of die-cast products. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A die-casting device at least comprising a housing having a seat, a lower mold mechanism at the seat, an oil-pressured injection mechanism joined with a lower section of the lower mold mechanism, and a corresponding upper mold mechanism disposed at an upper section of the housing and driven by an oil-pressured mechanism for up-and-down movements; and being characterized that, the lower mold mechanism is devised with an outwardly inclined angle, wherein the lower mold mechanism is located at a center of an upper section of the seat, and is supported and located using symmetrical oil-pressured valves; each of the two oil-pressured valves has an upper end of an outer tube thereof provided with a perpendicularly and outwardly projected axis, which is pivotally joined with an axis housing respectively disposed at two upper sides of the seat; parallel to the rotation axes of the oil-pressured valves, the seat has a crank axis seat and a pivotal axis at one upper side thereof; a pivotal crank is formed by penetrating the pivotal axis through the crank axis seat; the crank has an upper end thereof fastened at a side wall of a mold housing of the lower mold mechanism, and a lower end thereof fastened at a region between the mold housing of the lower mold mechanism and the injection mechanism to form one body with the lower mold mechanism; when the oil-pressured valves are contracted, the lower mold mechanism is enabled to mold and cast by placing the mold seat thereof on the housing; and when the oil-pressured valves are extended, the lower mold mechanism and the injection mechanism are together ascended, and are rotated outward regarding the pivotal axis as a center thereof to become inclined.

2. The die-casting device in accordance with claim 1, wherein the inclined angle of the lower mold mechanism is between 30 degrees and 50 degrees.

3. The die-casting device in accordance with claim 1, wherein a piston of the injection mechanism simultaneously contracts downwards when adding a metal liquid, such that the metal liquid is allowed with buffer effects for reception when being filled into the material reservoir.

* * * * *